US005113534A

United States Patent [19]

Lane et al.

[11] Patent Number: 5,113,534

[45] Date of Patent: May 19, 1992

[54] FIREFIGHTER'S HELMET HAVING TILT ADJUSTMENT

[75] Inventors: Abbott A. Lane, Dayton; John M. Hetzel, Jr., Kettering, both of Ohio

[73] Assignee: Firequip Helmets, Inc., Dayton, Ohio

[21] Appl. No.: 656,843

[22] Filed: Feb. 19, 1991

[51] Int. Cl.[5] ..... A42B 3/00

[52] U.S. Cl. ..... 2/416; 2/5

[58] Field of Search ..... 2/5, 416, 420, 417, 2/418, 419

[56] References Cited

U.S. PATENT DOCUMENTS

| | | | |
|---|---|---|---|
| 3,018,483 | 1/1962 | Austin | 2/417 |
| 3,221,340 | 12/1965 | Joffe | 2/417 |
| 3,241,154 | 3/1966 | Aileo | 2/419 |
| 3,383,705 | 5/1968 | Raschke | 2/416 |
| 3,714,668 | 2/1973 | Mirabella | 2/419 |
| 3,994,023 | 11/1976 | Aileo et al. | 2/417 |
| 4,056,852 | 11/1977 | Greendale | 2/417 |
| 4,833,735 | 5/1989 | Long et al. | 2/419 |

FOREIGN PATENT DOCUMENTS

| | | | |
|---|---|---|---|
| 321934 | 6/1989 | European Pat. Off. | 2/5 |
| 2349795 | 4/1975 | Fed. Rep. of Germany | 2/416 |

*Primary Examiner*—Werner H. Schroeder
*Assistant Examiner*—Michael A. Neas
*Attorney, Agent, or Firm*—Jacox & Meckstroth

[57] ABSTRACT

A firefighter's helmet the weight of which, and of any accessories associated therewith, may be unevenly distributed. The helmet has an inwardly disposed crown support assembly to engage the head of the wearer. The crown support assembly is adjustable to change the angular position of the helment upon the head of the firefighter to compensate for uneven weight distribution in the helmet.

12 Claims, 2 Drawing Sheets

FIREFIGHTER'S HELMET HAVING TILT ADJUSTMENT

BACKGROUND OF THE INVENTION

In the art of protective headgear such as helmets worn by firefighters, police and military personnel, construction workers, athletes and others, it has long been the practice to employ relatively rigid and relatively heavy protective shells of impact-resistant materials to protect the head of the wearer. Usually, such helmets have been provided with visors or face masks or shields which can be either permanently or selectively positioned in front of and at least partially covering the eyes or even the entire face of the wearer. Especially in the case of firefighters, helmets, it has also been the practice to include layers of heat resistant materials to the shell, thereby to protect the wearer from heat as well as from injuries by falling objects.

Because direct contact of the shell with the head of the wearer would be irritating, but even more for added protection from impact and/or ambient heat, such prior art headgear has incorporated means for holding the shell away from the head. Typically, such means have embodied a headband which encircles and embraces the head of the wearer while being resiliently in spaced relation from the outer shell.

To support the bulk of the weight of the entire headgear and to keep the upper portion of the outer shell spaced from the top of the wearer's head, a crown support assembly comprising a web of crisscrossing straps is conventionally affixed to the headband. To hold the straps in their desired crisscrossing configuration and to distribute the headgear weight over a larger area of the wearer's head, the crown support assembly typically also includes a crown pad associated with the straps adjacent the point of their intersection at or near the center of the headgear.

As is to be expected, even though somewhat lighter plastics and treated fabric reinforcements have replaced the metals that were originally used in such headgear, the mass required for an acceptable degree of protection from impact and/or ambient heat, has caused the headgear to be relatively heavy. Moreover, where additional accessory components, such as face shields, communication or breathing apparatus and the like, have been associated with the protective outer shells of the headgear, the overall weight of the headgear has been even further increased. Typically, in the case of the association of such additional components, the weight, and especially the added weight, is not uniformly distributed, with the result that one part, usually the front, of the headgear shell is considerably heavier than other portions of the shell.

While the weight of such headgear has itself been a problem from the standpoint of additional stress and fatigue factors, it has recently come to be recognized that, where the weight of the shell is unevenly distributed, such problems have become more acute. Additionally, it has been found that uneven weight distribution throughout the headgear as a whole has resulted in substantial interference with the balance and mobility of the wearer. All of these problems are even more pronounced where accessory devices are attached to or depend from the headgear.

It is accordingly an object of the present invention to provide improved protective headgear.

It is a further object of the invention to provide such improved headgear characterized by an outer shell which addresses problems in which the weight of the headgear and of any accessory apparatus associated therewith is unevenly or non-uniformly distributed.

It is a still further object of the invention to provide such headgear wherein uneven weight distribution in the headgear does not subject the wearer to excessive stress or fatigue.

Other objects and advantages of this invention reside in the construction of the headgear, the method of assembly and the mode of use, as will become more apparent from the following description.

SUMMARY OF THE INVENTION

The improvements afforded by the present invention derive first, from the recognition that the stress, fatigue and instability experienced by wearers of prior art headgear, the weight of which is unevenly distributed, are attributable to the wearer's conscious or subconscious efforts to adapt to and compensate for the imbalance of the headgear. In recognizing this problem, the inventors herein have found that the head of a wearer usually contacts and supports the headgear at the same portion of the headgear, regardless of the manner and degree in which the headgear weight is distributed. Therefore, the center of gravity of the headgear and its associated accessories can be positioned at the head contact portion by tilting upwardly the region of greater weight concentration. Furthermore, such tilting can be accomplished by moving the head contact portion of the headgear toward the area of such greater weight concentration.

Related to the foregoing is the inventors, further discovery that the precise portion of the effective support of such headgear depends to a substantial degree upon the size, shape and contour of the wearer's head, with the result that the optimum position of support differs from one person to another. The inventors herein accordingly provide means for adjusting the head contact portion of the headgear, thereby adjusting the degree of tilting of the head gear. Such adjustability is also important when the degree of imbalance of the weight distribution is changed by the addition or subtraction of accessory apparatus.

The headgear of the present invention accordingly comprises an outer shell, a head-encircling and engaging assembly comprising a headband within the outer shell and a crown support assembly for encircling and resting upon the head of the wearer, whereby the shell is held in spaced relation from the wearer's head. The invention includes means for altering the crown support assembly to tilt the headgear so that its effective center of gravity is positioned at the area of contact of the wearer's head with the crown-support assembly. In a typical embodiment of the headgear of this invention, the altering means comprise means for changing the position of intersection of the crown straps and the crown pad. In a more specific embodiment of the present invention, the means for changing the position of the crown pad are adjustable.

The invention thus generally described may be more clearly understood by reference to the following detailed description of the preferred embodiment thereof in connection with which reference may be had to the appended drawings.

DETAILED DESCRIPTION OF THE PREFERRED EMBODIMENT

Figure 1:
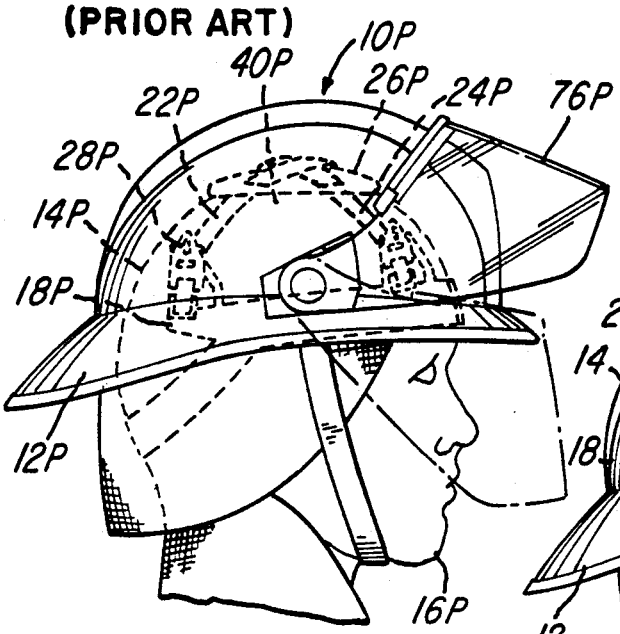
FIG-1 (PRIOR ART)
FIG. 1 is a side view of a prior art firefighter's helmet showing the manner in which the helmet rests upon the head of a firefighter.
Figure 2:
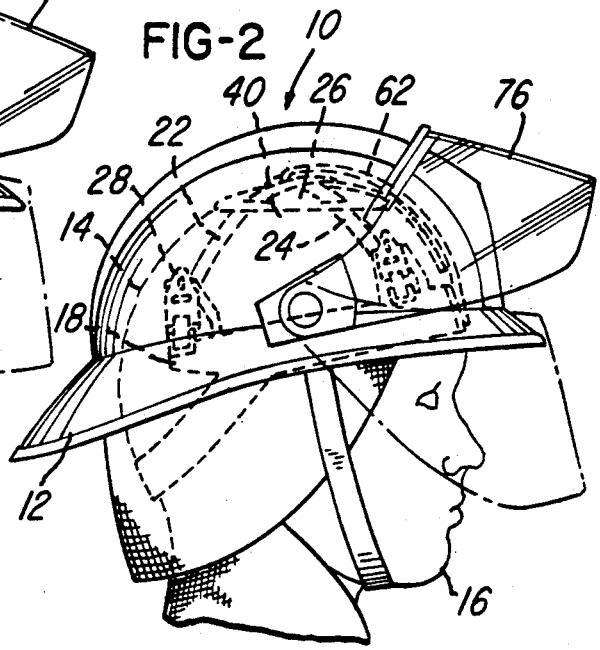
FIG. 2 is a side view of a firefighter's helmet according to this invention, showing the manner in which the helmet rests upon the head of a firefighter.

In the following description, the identification of particular parts and components which prior art headgear of the type illustrated in FIG. 1 has in common with headgear constructed in accordance with the present invention as illustrated in FIGS. 2 through 5, will be by the same reference numerals, except that those of the prior art will be followed by the letter "P".

Protective headgear of this invention comprises a firefighter's helmet 10, illustrated in the drawings. Typically, such a helmet consists of an outer shell 12, made of a relatively rigid material, such as molded, fiber-reinforced plastics materials. The outer shell 12 is held in spaced relation to the head 14 of a wearer 16 by a head-embracing assembly 18. The head-embracing assembly 18 comprises a headband 20 and the crown support assembly which includes crisscrossing crown straps 22 and 24 and a crown pad 26. Conventionally, means are provided for some resilient movement of the shell 12 relative to the head-embracing assembly 18 and, in turn, to the head 14 of the wearer 16, thereby to absorb at least some of the energy of an object striking the shell 12. In the illustrated embodiment, such means comprise resilient fasteners 28, tab components 30 of which are integrally formed as part of the headband 20 at 32 and joined clip components 34 which are affixed to a rim 36 of the shell 12 at positions 38.

The shell 12 is thus held away from the sides of the head 14 of the wearer 16 by the headband 20. The upper portion of the shell 12 is maintained away from a crown 40 of the wearer's head 14 by the crisscrossing crown straps 22 and 24 and the associated crown pad 26. Therefore, all or most of the weight of the shell 12 is supported by the contact between the crown 40 of the wearer's head 14 and the crown pad 26.

Figure 3:
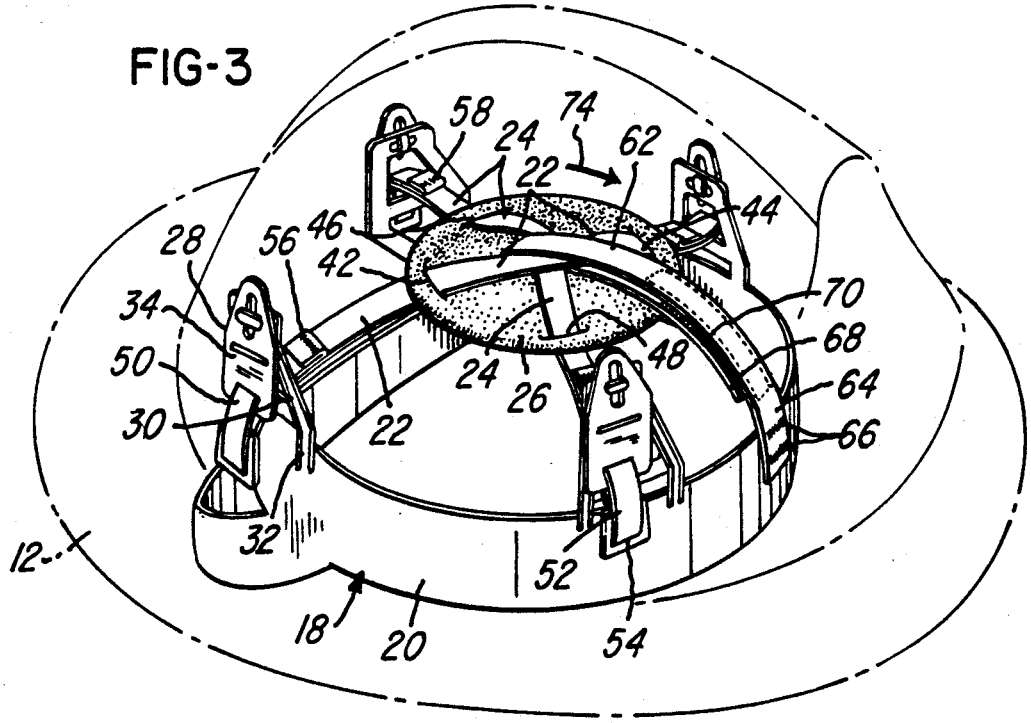
FIG. 3 is a perspective view of the head-engaging assembly of a firefighter's helmet according to this invention wherein the shell of the helmet is shown in phantom.
Figure 4:
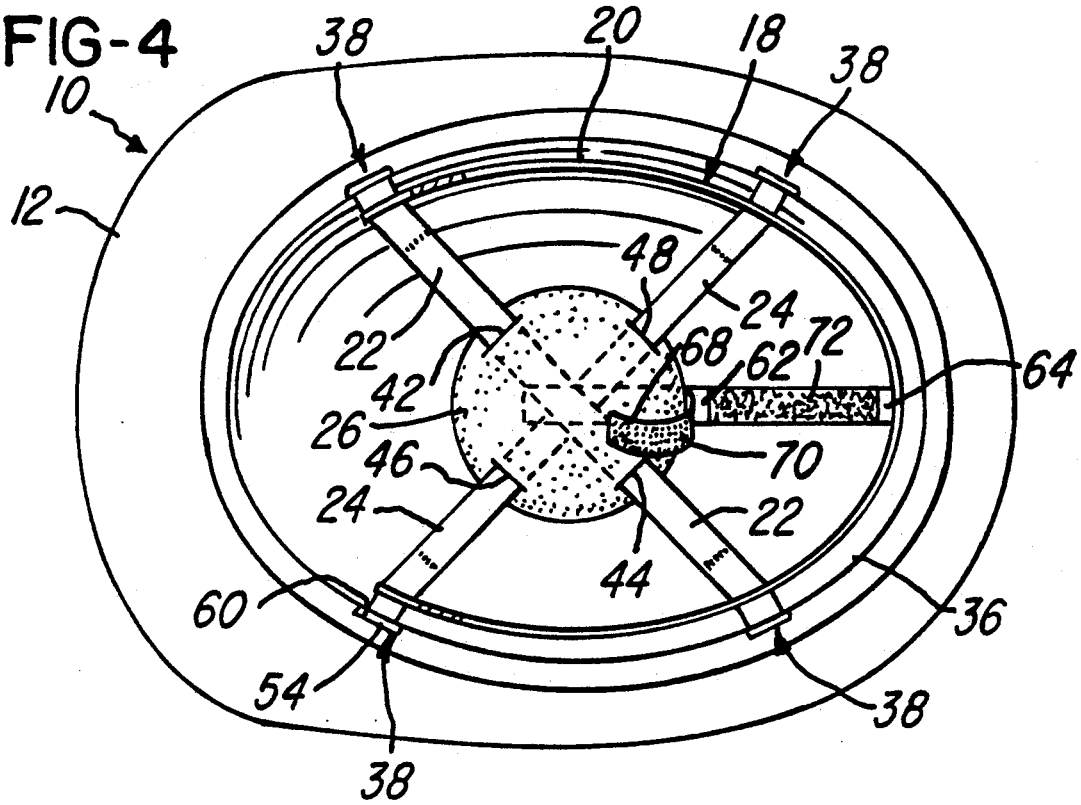
FIG. 4 is a plan view of the bottom of a firefighter's helmet according to this invention showing the crown straps and crown pad in their pre-adjusted positions.

As best shown in FIG. 3, the crown pad 26 is provided with a first pair of diametrically disposed slits and 44 through which the crown strap 22 is threaded to overlie the crown pad 26. The crown pad 26 is also provided with a second pair of diametrically disposed slits 46 and 48 through which the crown strap 24 is threaded to overlie the crown pad 26. Therefore, the crown pad 26 is positioned at the point of the intersection between the crown straps 22 and 24. If the crown pad 26 should be omitted, it will be appreciated that the weight of the shell 12 would be supported by the contact of the crown 40 of the wearer's head 14 with the straps 22 and 24 focused at the point of their intersection or virtual intersection. The crown straps 22 and 24 have outer ends 50 and 52, respectively, which are looped through openings (not shown) in shell rim anchor portions 54 of the fasteners 28. The outer ends 50 and 52 are stitched back to a part of the respective strap 22 and 24, as shown at positions 56 and 58. When the anchor portions 54 are inserted into the rim grooves 60, the portions of the straps 22 and 24 passing through the anchor portions 54 are themselves anchored within the rim 36 and thereby to the shell 12. However, the anchor portions 54 remain operatively and resiliently associated with the head embracing assembly 18.

The improvements afforded by the present invention derive from a controlled repositioning or relocation of the point of intersection of the crown straps 22 and 24 and/or of the crown pad 26 associated therewith. In the preferred embodiment shown, locating means for accomplishing such repositioning or relocation of the crown pad 26 comprise an adjustment strap 62 having an outer end portion 64 which is stitched as at 66 or otherwise affixed to the headband 20. The adjustment strap 62 also has an opposite end portion 68. Between the end portions 64 and 68, the adjustment strap 62 is looped around the intersecting, crisscrossing crown straps 22 and 24 at or near the point of their intersection. The end portion 68 of the adjustment strap 62 is provided with selectively adjustable fastening means, such as a hook and pile element 70. The adjustment strap 62 has secured thereto a complementary hook and pile element 72.

Figure 5:
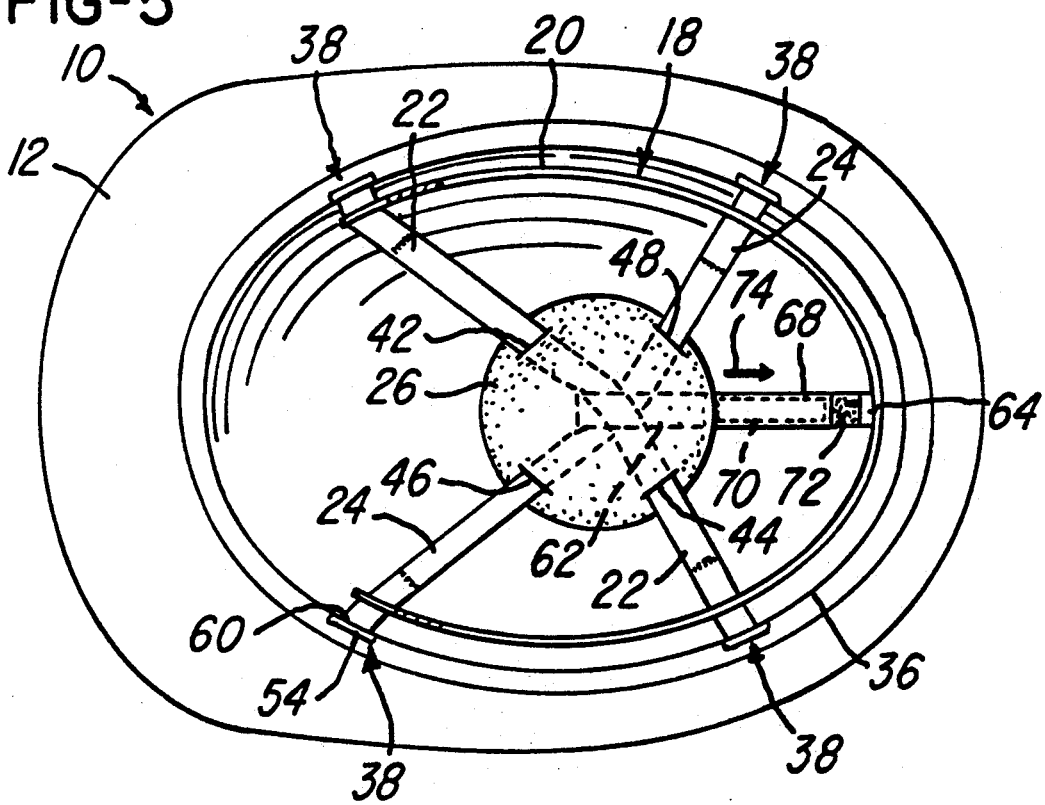
FIG. 5 is a plan view of the bottom of the firefighter's helmet of FIG. 4 showing the crown straps and crown pad in adjusted positions.

As shown in FIG. 5, the end portion 68 of the adjustment strap 62 is pulled forward in the direction illustrated by an arrow 74 and the point of the intersection of the crown straps 22 and 24 and the crown pad 26 are similarly moved forward. Then the hook and pile element 70 is attached to the hook and pile element 72. The result of such adjustment means is that the point of intersection of the crown straps 22 and 24 and/or the location of the crown pad 26 are readily adjusted from the normal location of the crown pad 26. Therefore, when the helmet 10 is positioned upon the head 14 of the wearer 16, the forward portion of the helmet 10 is tilted upwardly from the position shown in FIG. 1 to the position shown in FIG. 2. Such tilting of the helmet 10 thus results in a shifting of the effective center of gravity of the mass of the outer shell 12 with respect to the crown pad 26.

In the case of headgear such as the firefighter's helmet 10 illustrated in the drawings, the shell 12 is customarily heavier at its forward portion as a result of a face shield 76 and other accessories. The illustrated embodiment is adapted to accommodate such weight distribution because the adjustment strap 62 is so mounted that the tightening thereof around the crown straps 22 and 24 moves the intersection of the crown straps 22 and 24 and the crown pad 26 forwardly in the direction of the greater concentration of weight. As explained above and as can be seer from a further comparison of FIGS. 1 and 2, this movement causes the helmet 10 to tilt downwardly at the rearward portion thereof and the forward portion of the helmet at which the weight is concentrated to tilt upwardly. It is this tilting which effectively balances the helmet 12 upon the head 14 of the wearer 16 and compensates for the uneven weight distribution in the helmet 12. This balance substantially reduces the stress, fatique and destabilization which would otherwise occur.

The desired location of the intersection of the crown straps 22 and 24 and the crown pad 26 associated therewith can be established in a relatively permanent or non-adjustable mode. However, an important added feature of the present invention is the adjustability of the location of the crown pad 26 to accommodate changes which occur in the accessories carried by the helmet 12. While the crown straps 22 and 24 are shown to traverse the entire area defined by the headband 20 and to pass through the crown pad 26 and be affixed at their opposite ends to diametrically opposite points of the headband 20, the crown support assembly could comprise a plurality of shorter straps anchored at one of their ends to the headband and at the other of their ends to the crown pad 26 or to a ring or other substitute for the crown pad. In such a case, the shorter crown straps would not actually traverse the area defined by the headband 20 or intersect; but the objects of the present invention could nonetheless be achieved by regarding them as virtually traversing such area and treating the point of their virtual intersection as their point of actual inter section.

Although the preferred embodiment of the firefighter's helmet of this invention has been described, it will be understood that within the purview of this invention various changes may be made in the form, details, proportion and arrangement of parts, the combination thereof, method of construction and the mode of use, which generally stated consists in a firefighter's helmet within the scope of the appended claims.

The invention having thus been described, the following is claimed:

1. In a firefighter's helmet having an outer shell and an inwardly disposed crown support assembly wherein the weight of the shell and of any accessories associated therewith are unevenly distributed, the improvement in which the drawn support assembly comprises tilting means for tilting the heavier portion of the outer shell upwardly as the helmet is positioned upon the head of a firefighter, whereby the helmet is balanced upon the head of the firefighter, and whereby stress upon the firefighter which involves the helmet is minimal the crown support assembly comprising intersecting crisscrossing crown straps and said tilting means also comprising locating means for adjusting the point of intersection of the drawn straps, the locating means comprising an adjustment strap, one end of which is looped around the crown straps at the point of intersection thereof and the other end of the adjustment strap being fixed relative to said crown support assembly.

2. In a firefighter's helmet having an outer shell and an inwardly disposed crown support assembly wherein the weight of the shell and of any accessories associated therewith are unevenly distributed, the improvement in which the crown support assembly comprises tilting means for tilting the heavier portion of the outer shell upwardly as the helmet is positioned upon the head of a firefighter, whereby the helmet is balanced upon the head of the firefighter, and whereby stress upon the firefighter which involves the helmet is minimal, the crown support assembly comprising intersecting crisscrossing crown straps and said tilting means also comprising locating means for adjusting the pint of intersection of said crown straps, said locating means comprising and adjustment strap, one end of which is looped to form a loop around the crown straps at the point of the intersection thereof and the other end of the adjustment strap being fixed relative to said crown support assembly, the adjustment strap including means for selectively changing the size of said loop and the location of said point of intersection.

3. In a firefighter's helmet having an outer shell and an inwardly disposed crown support assembly wherein the weight of the shell and of any accessories associated is unevenly distributed, the improvement in which the crown support assembly comprises tilting means for tilting the heavier portion of the outer shell upwardly as the helmet is positioned upon the head of a firefighter, whereby the helmet is balanced upon the head of the firefighter, and whereby stress upon the firefighter which involves the helmet is minimal, the crown support assembly comprising intersecting crisscrossing crown straps and said tilting means also comprising locating means for adjusting the point of intersection of said crown straps, said locating means comprising an adjustment strap one end of which is looped to form a loop around the crown straps at the point of the intersection thereof and the other end of the adjustment strap being fixed relative to said crown support assembly, said loop including affixing means for affixing said one end of said adjustment strap upon another portion of said adjustment strap.

4. In a firefighter's helmet having an outer shell and an inwardly disposed crown support assembly wherein the weight of the shell and of any accessories associated is unevenly distributed, the improvement in which the crown support assembly comprises tilting means for tilting the heavier portion of the outer shell upwardly as the helmet is positioned upon the head of a firefighter, whereby the helmet is balanced upon the head of the firefighter and whereby stress upon the firefighter which involves the helmet is minimal, the crown support assembly comprising intersecting crisscrossing crown straps and said tilting means also comprising locating means for adjusting the point of intersection of said crown straps, said locating means comprising an adjustment strap, one end of which comprises a loop positioned about the crown straps at the point of the intersection thereof and the other end of the adjustment strap being fixed relative to said crown support assembly, and affixing means for affixing said one end of said adjustment strap to another portion of said adjustment strap.

5. In a firefighter's helmet having an outer shell and an inwardly disposed crown support assembly wherein the weight of the shell and of any accessories associated is unevenly distributed, the improvement in which the crown support assembly comprises tilting means for tilting the heavier portion of the outer shell upwardly as the helmet is positioned upon the head of a firefighter, whereby the helmet is balanced upon the head of the firefighter, and whereby stress upon the firefighter which involves the helmet is minimal, the crown support assembly comprising intersecting crisscrossing crown straps and said tilting means also comprising locating means for adjusting the point of intersection of said crown straps, said locating means comprising an elongate adjustment member having a pair of end portions, one end portion being in the form of a loop around the crown straps at the point of the intersection thereof and the other end portion of the adjustment member being fixed relative to said crown support assembly, said loop being formed by affixing said one end portion of said adjustment member upon another portion of said adjustment member, said one end portion of said adjustment member being adjustably affixed to another portion of the adjustment member by hook and pile means,.

6. A firefighter's helmet comprising an outer shell and an inwardly disposed head-embracing assembly wherein the weight associated with the outer shell is more concentrated at one portion thereof, the improvement which comprises tilting means, means operably connecting the tilting means to said head embracing assembly for adjusting a portion of the head embracing assembly with respect to the outer shell, said head embracing assembly comprising a head band and intersecting crown straps affixed to the headband, a crown pad engageable with the head of the firefighter who wears the firefighter's helmet, connection means adjustably connection the crown pad to the crown straps whereby the crown pad is carried by the crown straps and movable with respect to the crown straps, and whereby the crown pad is movable with respect to the outer shell, and fastening means joined to the crown straps for retaining the crown pad at the location to which the crown pad is moved.

7. A firefighter's helmet comprising an outer shell and an inwardly disposed head-embracing assembly wherein the weight associated with the outer shell is more concentrated at one portion thereof, the improvement which comprises tilting means, means operably connecting the tilting means to said head embracing assembly for adjusting a portion thereof with respect to the outer shell, whereby the outer shell is tilted with respect to the head of the firefighter upon whose head the outer shell is positioned and whereby the helmet is balanced upon the head of the firefighter who wears the helmet and whereby stress upon the firefighter as a result of the helmet is minimal, the head embracing assembly comprising a headband and intersecting crown straps affixed to the headband and said tilting means comprising locating means for moving the position of the intersection of the crown straps with respect to the portion of the shell at which such weight is more concentrated, said locating means comprising an adjustment strap, means connecting the adjustment strap to the headband, the adjustment strap including a portion in the form of a loop around said position of intersection of the crown straps, and means attaching the adjustment strap to said headband.

8. A firefighter's helmet comprising an outer shell and an inwardly disposed head-embracing assembly wherein the weight associated with the outer shell is more concentrated at one portion thereof, the improvement which comprises tilting means, means operably connecting the tilting means to said head embracing assembly for adjusting a portion of the head embracing assembly with respect to the outer shell, whereby the outer shell is tilted with respect to the head of the firefighter upon whose head the outer shell is positioned and whereby the helmet is balanced upon the head of the firefighter who wears the helmet and whereby stress upon the firefighter as a result of the helmet is minimal, the head embracing assembly comprising a headband and intersecting crown straps affixed to the headband and said tilting means comprising locating means for moving the position of the intersection of the crown straps wit respect to the portion of the outer shell at which such weight is more concentrated, the locating means comprising an adjustment strap, a portion of the adjustment strap being in the form of a loop around the intersecting crown straps and another portion of the adjustment strap being attached to the headband, and fastening means for retaining the position of intersection of the crown straps at the location to which the intersection is moved.

9. A firefighter's helmet comprising an outer shell and an inwardly disposed head-embracing assembly wherein the weight associated with the outer shell is more concentrated at one portion thereof, the improvement which comprises tilting means, means operably connecting the tilting means to said head embracing assembly for adjusting a portion thereof with respect to the outer shell, whereby the outer shell is tilted with respect to the head of the firefighter upon whose head the outer shell is positioned and whereby the helmet is balanced upon the head of the firefighter who wears the helmet and whereby stress upon the firefighter as a result of the helmet is minimal, the head-embracing assembly comprising a headband and intersecting crown straps affixed to the headband, the position of intersection of the crown straps determining the angular condition of the helmet with respect to the head of the firefighter as the helmet is positioned upon the head of the firefighter, and said tilting means comprising locating means for moving the position of intersection of the crown straps with respect to the portion of the shell at which such weight is more concentrated, said locating means comprising an adjustment strap, one portion of the adjustment strap being looped around said position of intersection of the crown straps and another portion of the adjustment strap being attached to said headband, and fastening means for retaining said position of intersection of the crown straps at the location to which the intersection is moved, said fastening means comprising a hook and pile element affixed to said portion of the adjustment strap which is looped and a complementary hook and pile element affixed to another portion of the adjustment strap.

10. The method of construction of a firefighter's helmet for the head of a firefighter in which the helmet includes an outer shell in which the weight associated with the outer shell is more concentrated at one portion thereof, securing a headband within the outer shell, positioning intersecting crown straps within the outer shell, attaching the intersecting crown straps to the headband, attaching adjustment means to the intersecting crown straps for moving the position of intersection of the crown straps with respect to the portion of the outer shell at which such weight is more concentrated, attaching a crown pad to the intersecting crown straps for support of the crown pad by the crown straps adjacent the intersection of the crown straps, and attaching locating means to the intersecting crown straps for moving the position of the intersection of the crown straps and for moving the crown pad with respect to the portion of the outer shell at which such weight is more concentrated.

11. A firefighter's helmet comprising a shell member, a support assembly within the shell member, means connecting the support assembly to the shell member, the support assembly including an elongate crown strap, a crown pad adjustably attached to the elongate crown strap and movable with respect thereto, adjustment means joined to the crown strap for adjusting the position of the crown pad with respect to the crown strap and with respect to the shell member, whereby the angular relationship of the shell member with respect tot he head of the firefighter is adjustable as the crown pad is positioned at a desired location upon the head of the firefighter, whereby any stress upon the firefighter as a result of wearing the helmet is minimal.

12. The method of construction of a firefighter's helmet for the head of a firefighter in which the helmet includes an outer shell in which the weight associated with the outer shell is more concentrated at one portion thereof, securing a headband within the outer shell, positioning intersecting crown straps within the outer shell, attaching the intersection crown straps to the headband, attaching adjustment means to the intersection of the intersecting crown straps for moving the position of intersection of the crown straps with respect to the portion of the outer shell at which such weight is more concentrated, attaching a crown pad to the intersecting crown straps for support of the crown pad by the crown straps adjacent the intersection of the crown straps, whereby adjustment of the attachment means adjusts the position of the intersection of the intersecting crown straps and thus adjusts the position of the crown pad with respect to the portion of the outer shell at which such weight is more concentrate.

* * * * *

UNITED STATES PATENT AND TRADEMARK OFFICE

CERTIFICATE OF CORRECTION

PATENT NO. : 5,113,534

DATED : May 19, 1992

INVENTOR(S) : Abbott A. Lane and John M. Hetzel, Jr.

It is certified that error appears in the above-identified patent and that said Letters Patent is hereby corrected as shown below:

Column 1, line 16 after "firefighters" omit the comma and substitute an apostrophe (').

Column 2, line 35, after "inventors" omit the comma and substitute an apostrophe (').

Column 2 line 43, change "head gear" to ---headgear---.

Column 3, line 58, after "slits" insert ---42---.

Column 4, line 59, change "seer" to ---seen---.

Column 5, line 22, change "inter section" to ---intersection---.

Column 5, line 37, change "drawn" to ---crown---.

Column 5, line 42, after "minimal" insert a comma (,).

Column 5, line 46, change "drawn" to ---crown---.

Column 7, line 15, change "connection" to ---connecting---.

Column 7, line 63, change "wit" to ---with---.

UNITED STATES PATENT AND TRADEMARK OFFICE

CERTIFICATE OF CORRECTION

PATENT NO. : 5,113,534

DATED : May 19, 1992

INVENTOR(S) : Abbott A. Lane and John M. Hetzel, Jr.

It is certified that error appears in the above-identified patent and that said Letters Patent is hereby corrected as shown below:

Column 8, line 40, after "shell" cancel ---in which the weight associated with---.

Column 8, line 41, cancel "the outer shell".

Column 8, line 67, change "tot he" to ---to the---.

Column 9, line 9, change "intersection" to ---intersecting---.

Column 10, line 10, change "concentrate" to ---concentrated---.

Signed and Sealed this

Thirteenth Day of July, 1993

*Attest:*

Michael K. Kirk

MICHAEL K. KIRK

*Attesting Officer*

*Acting Commissioner of Patents and Trademarks*